US009618250B2

(12) United States Patent
Park

(10) Patent No.: US 9,618,250 B2
(45) Date of Patent: Apr. 11, 2017

(54) REFRIGERATOR

(71) Applicant: SAMSUNG ELECTRONICS CO., LTD., Suwon-si, Gyeonggi-do (KR)

(72) Inventor: Sang Min Park, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 614 days.

(21) Appl. No.: 13/684,944

(22) Filed: Nov. 26, 2012

(65) Prior Publication Data

US 2013/0133354 A1 May 30, 2013

(30) Foreign Application Priority Data

Nov. 29, 2011 (KR) ..... 2011-0126253

(51) Int. Cl.

| | |
|---|---|
| ***F25D 11/00*** | (2006.01) |
| ***F25D 11/02*** | (2006.01) |
| ***F25D 23/12*** | (2006.01) |
| ***B67D 3/00*** | (2006.01) |
| ***F25C 1/00*** | (2006.01) |

(52) U.S. Cl.

CPC ..... *F25C 1/00* (2013.01); *F25D 11/00* (2013.01); *F25D 23/126* (2013.01); *F25C 2400/10* (2013.01); *F25C 2400/14* (2013.01); *F25D 2323/122* (2013.01)

(58) Field of Classification Search

CPC ..... F25D 11/00; F25D 11/02; F25D 11/022; F25D 2323/122; F25D 23/126; B67D 2210/00036; B67D 3/0009

See application file for complete search history.

(56) References Cited

U.S. PATENT DOCUMENTS

| | | | | |
|---|---|---|---|---|
| 3,969,909 | A | 7/1976 | Barto et al. | |
| 8,434,318 | B2 * | 5/2013 | Kim | 62/340 |
| 2007/0251245 | A1 * | 11/2007 | Sakitani et al. | 62/6 |

(Continued)

FOREIGN PATENT DOCUMENTS

| | | | |
|---|---|---|---|
| CN | 101384871 | A | 3/2009 |
| GB | 2426570 | A | 11/2006 |

(Continued)

OTHER PUBLICATIONS

Chinese Office Action mailed Dec. 14, 2015 in related Chinese Application No. 201210499874.7.

*Primary Examiner* — Frantz Jules
*Assistant Examiner* — Erik Mendoza-Wilkenfe
(74) *Attorney, Agent, or Firm* — Staas & Halsey LLP

(57) ABSTRACT

A refrigerator includes a water storage vessel configured to be mounted to the door of the refrigerator, a supply passage configured to connect the storage space of the water storage vessel to an ice making apparatus and dispenser to supply the water in the water storage vessel to the ice making apparatus and the dispenser, a valve installed at an intersection of the supply passage and configured to perform a passage conversion, and a pump configured to pump the water in the water storage vessel so that the water flows to the supply passage, wherein the water storage vessel is provided with a water storage vessel lever capable of changing the position of at least one portion of the supply passage so that the at least one portion of the supply passage is connected to/disconnected from a remaining portion of the supply passage.

14 Claims, 17 Drawing Sheets

(56) References Cited

U.S. PATENT DOCUMENTS

| | | | | |
|---|---|---|---|---|
| 2009/0301587 | A1* | 12/2009 | Takagi et al. | 137/565.22 |
| 2010/0218541 | A1 | 9/2010 | Kim | |
| 2010/0251747 | A1* | 10/2010 | Lee | 62/347 |
| 2011/0303693 | A1* | 12/2011 | Culley et al. | 222/1 |

FOREIGN PATENT DOCUMENTS

| | | | | |
|---|---|---|---|---|
| JP | 2004177068 | A | * | 6/2004 |
| WO | 2011/013953 | A2 | | 2/2011 |

* cited by examiner

REFRIGERATOR

CROSS-REFERENCE TO RELATED APPLICATIONS

This application claims the benefit of Korean Patent Application No. 2011-0126253, filed on Nov. 29, 2011 in the Korean Intellectual Property Office, the disclosure of which is incorporated herein by reference.

BACKGROUND

1. Field

Embodiments of the present disclosure relate to a refrigerator having an ice making apparatus or a dispenser, and more particularly, to a refrigerator configured to be supplied with water from a water storage vessel that is detachably mounted to the refrigerator instead of receiving water while connected to a faucet from an outside water supply source.

2. Description of the Related Art

In general, a refrigerator is an apparatus provided with a storage compartment therein to store foods and a cool air supply device to supply cool air to the storage compartment to keep food fresh through a cooling cycle.

The refrigerator as such is in the ever increasing trend of becoming larger in size following the change of lifestyle. As to satisfy the demand of users, an ice making apparatus which generates ice or a dispenser configured in a way that the water and the ice may be withdrawn from an outside the refrigerator are being mounted to the refrigerator.

The refrigerator provided with the ice making apparatus or the dispenser mounted thereto as such is needed with a water supply system configured to supply water to the ice making apparatus or the dispenser, and the water supply system as such, while including a pipe line that is connected to a faucet, is generally configured in a way that the water is directly supplied from an outside water supply source, and the water may be supplied to the ice making apparatus or the dispenser by the water pressure applied from the outside water supply source.

Meanwhile, instead of the water being supplied from the outside water supply source while being connected to a faucet, a refrigerator may receive water from a water storage vessel that is detachably mounted thereto. An example of the refrigerator as such has been disclosed in Korean Patent Publication No. 10-2010-0033494.

The refrigerator disclosed as such includes a water supplying container, a container connecting part configured to mount the water supplying container, a pump configured to pump the water of the water supplying container, and a second passage configured to connect the water supplying container, the ice making apparatus and the dispenser to one another. The refrigerator is also configured to supply water to the ice making apparatus or the dispenser as the water is pumped by the pump, when the water supplying container is connected to the container connecting part.

However, in accordance with the publication above, in a case when the water supplying container is to be mounted to the container connecting part, a portion of the second passage is needed to be disposed at an inside the water supplying container through the entry of the water supplying container, and thus, mounting of the water supplying container may not be easily performed.

In addition, since the second passage passes through an injection hole of the water supplying container, the injection of the water to the water supplying container may be difficult in a state when the water supplying container is mounted at the container connecting part. Accordingly, in a case when the water is needed to be injected to the water supplying container, it is necessary to inconveniently detach the water supplying container from the container connecting part prior to injecting water.

SUMMARY

Therefore, it is one aspect of the present disclosure, with respect to a refrigerator having a water supply system capable of supplying water to an ice making apparatus or a dispenser from a water storage vessel instead of supplying water from a water supply source of an outside, to provide the refrigerator having an enhanced convenience in mounting the water storage vessel.

It is one aspect of the present disclosure to provide a refrigerator configured to conveniently inject water to a water storage vessel even in a state that the water storage vessel is mounted to the refrigerator.

It is one aspect of the present disclosure to provide a refrigerator having a water supply system including a water storage vessel, a pump, and a valve compactly disposed at an inside of a housing provided at one side of a door of the refrigerator, thereby enhancing a space utilization and aesthetic beauty.

It is one aspect of the present disclosure, with respect to a passage changing apparatus configured to change the passage in order to supply the water in a water storage vessel to an ice making apparatus or a dispenser, to provide a refrigerator having a further compact size thereof and reduced production cost by using a plurality of check valves instead of a conventional 3-way valve.

Additional aspects of the disclosure will be set forth in part in the description which follows and, in part, will be apparent from the description, or may be learned by practice of the disclosure.

In accordance with one aspect of the present disclosure, a refrigerator includes a body, a door, an ice making apparatus, a dispenser, and a water supplying apparatus. The storage compartment may have a front surface available to be open at an inside the body. The door may be rotatably installed at the body to open/close the open front surface of the storage compartment. The ice making apparatus may be provided at an inside the body to generate ice. The dispenser may be configured to discharge water and ice to an outside the body. The water supplying apparatus may be configured to supply water to the ice making apparatus and the dispenser. The water supplying apparatus may include a water storage vessel, a bracket unit, a second passage, a valve and a pump. The water storage vessel may be provided with a body having a storage space formed at an inside thereof and provided with a first passage capable of intaking the water stored at the storage space. The bracket unit may be installed on a rear surface of the door and have the water storage vessel mounted thereto. The second passage may be connected to the first passage and capable of supplying the water in the water storage vessel to the ice making apparatus and the dispenser. The valve may be installed at an intersection of the second passage and configured to change a passage. The pump may be configured to pump the water in the water storage vessel so that the water flows to the second passage. The water storage vessel may be provided with a water storage vessel lever capable of changing the position of the first passage to either an ON position at which the first passage is connected to the second passage, or an OFF position at which the first passage is disconnected from the second passage. The first passage of the water storage vessel may be connected to the second passage and may supply the water stored at the water storage vessel to the ice making apparatus or the dispenser when the water storage vessel is mounted to the bracket unit and the position of the first passage moves to the ON position. The first passage of the water storage vessel is disconnected from the second passage when the position of the first passage moves to the OFF position or the water storage vessel is dismounted from the bracket unit.

The water storage vessel lever may include a pressing part capable of moving the water storage vessel lever by applying a pressure.

The water storage vessel may include an outside protrusion pipe protruded to an outer side from the body and an inside protrusion pipe protruded to an inner side from the body, and the outside protrusion pipe and the inside protrusion pipe may communicate with each other, and the outside protrusion pipe and the inside protrusion pipe form at least a portion of the first passage.

The outside protrusion pipe and the inside protrusion pipe may be integrally formed with the water storage vessel lever.

The outside protrusion pipe may be horizontally disposed.

The outside protrusion pipe may move in a vertical direction with respect to the rear surface of the door.

The water storage vessel lever may be provided at an upper surface of the body of the water storage vessel.

The bracket unit may include a base part coupled to the rear surface of the door, a guide part protruded from the base part to guide the connection of the second passage and the first passage and provided with a hollowness formed therethrough, and a connecting pipe inserted into the hollowness of the guide part and configured to form an entry to the second passage.

The connecting pipe may be fixedly installed at the bracket unit and horizontally disposed.

In accordance with another aspect of the present disclosure, a refrigerator includes a body, a storage compartment, a door, an ice making apparatus, a dispenser, a water storage vessel, a supply passage, a valve and a pump. The storage compartment may have a front surface available to be open at an inside the body. The door may be rotatably installed at the body to open/close the open front surface of the storage compartment. The ice making apparatus may be provided at an inside the body to generate ice. The dispenser may be configured to discharge water and ice to an outside the body. The water storage vessel may have a storage space to store water and configured to be mounted to the door. The supply passage may be configured to connect the storage space of the water storage vessel to the ice making apparatus and the dispenser to supply the water in the water storage vessel to the ice making apparatus and the dispenser. The valve may be installed at an intersection of the supply passage and configured to perform a passage conversion. The pump may be configured to pump the water in the water storage vessel so that the water flows to the supply passage. The water storage vessel may be provided with a water storage vessel lever capable of changing the position of at least one portion of the supply passage so that the at least one portion of the supply passage is connected to/disconnected from a remaining portion of the supply passage.

In accordance with one aspect of the present disclosure, a water storage vessel is provided with a first passage capable of intaking water. When the water storage vessel is mounted to a refrigerator, the first passage is connected to a second passage that is connected to an ice making apparatus or a dispenser so that the water in the water storage vessel may be supplied to the ice making apparatus or the dispenser.

In addition, when the water storage vessel is simply mounted from an upper side to a lower direction, the first passage is connected to the second passage, and thereby the mounting of the water storage vessel is convenient.

In addition, the first passage of the water storage vessel is formed in a way to penetrate a rear surface of the water storage vessel, and an injection hole configured to inject water to the water storage vessel is formed at an upper surface of the water storage vessel, so that water may be easily injected to the water storage vessel even in a state that the water storage vessel is mounted to the refrigerator.

In addition, a pump housing to accommodate a pump and a valve is integrally provided at one side of the bracket unit which is available to have the water storage vessel mounted thereto, and thus, the pump, the valve, and the bracket unit may be assembled with a simple structure while a space utilization and aesthetic beauty may be enhanced.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
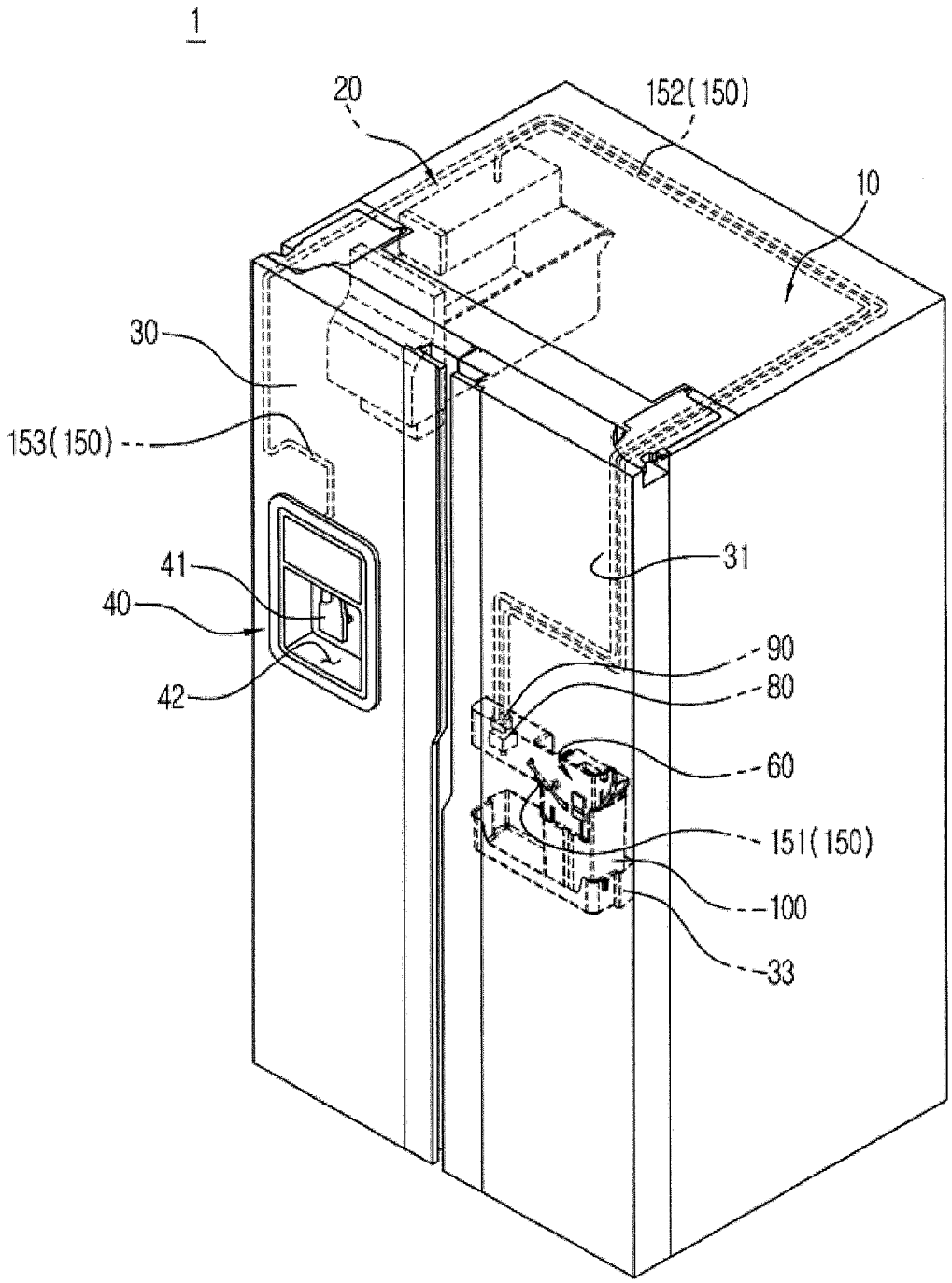
FIG. 1 is a schematic view of a water supply system of a refrigerator in accordance with a first embodiment of the present disclosure.

Reference will now be made in detail to the embodiments of the present disclosure, examples of which are illustrated in the accompanying drawings, wherein like reference numerals refer to like elements throughout.

Figure 2:
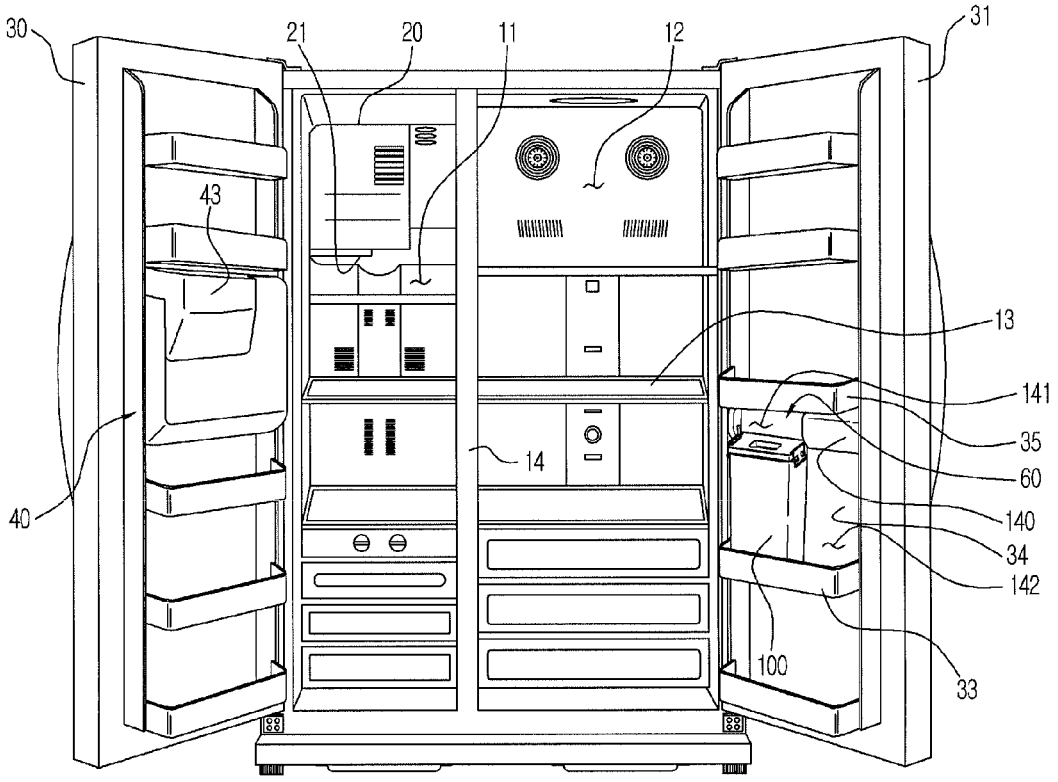
FIG. 2 is a frontal view of the refrigerator of FIG. 1.

FIG. 1 is a schematic view of a water supply system of a refrigerator in accordance with a first embodiment of the present disclosure. FIG. 2 is a frontal view of the refrigerator of FIG. 1.

As illustrated on FIGS. 1 to 2, a refrigerator 1 according to a first embodiment of the present disclosure includes a body 10 forming an exterior, storage compartments 11 and 12 provided at the inside the body 10 to store foods therein, and a cooling apparatus (not shown) to supply cool air to the storage compartments 11 and 12 to keep the foods fresh stored therein.

The storage compartments 11 and 12 may be divided by a middle wall 14 into the storage compartment 11 on the left and the storage compartment 12 on the right. The storage compartment 11 on the left may be used as a freezing compartment to keep the foods frozen, and the storage compartment 12 in the right may be used as a refrigerating compartment to keep the foods refrigerated.

The storage compartments 11 and 12 are provided thereon with an open front surface to store or take out the foods, and the open front surface may be open/closed by a left door 30 and a right door 31 that are rotatively coupled by use of hinge to the body 10. The storage compartments 11 and 12 may be provided with at least one of a shelf 13 so that the foods may be placed thereon, and the inside space of the storage compartments 11 and 12 may be divided by the shelf 13 into an upper space and a lower space.

In addition, the refrigerator 1 may further include an ice making apparatus 20 that generates ice. The ice making apparatus 20 may be provided at one side of the storage compartment 11. The ice making apparatus 20 may include an ice making tray on which ice is generated, a water supplying part configured to supply water to the ice making tray, and an auger apparatus configured to move the ice generated on the ice making tray to a discharging port 21.

Thus, as illustrated on FIG. 2, the ice of the ice making apparatus 20 may be moved to an inlet port 43 of a dispenser 40, which will be described later, through the discharging port 21, and finally the ice maybe discharged to an intake space 42 of the dispenser 40.

In addition, the refrigerator 1 may be provided therein with the dispenser 40 so that water or ice may be taken out from an outside the refrigerator 1 without having to open the doors 30 and 31. The dispenser 40 may be provided at the left door 30.

The dispenser 40 may include the intake space 42 configured to position a container capable of receiving water or ice being discharged, and a lever 41 configured to discharge water or ice.

Meanwhile, the refrigerator 1, as illustrated on FIG. 1, includes a water supplying apparatus configured to supply water to the ice making apparatus 20 and the dispenser 40.

The water supplying apparatus may include a water storage vessel 100 capable of storing the water to be supplied to the ice making apparatus 20 and the dispenser 40, a pump 80 capable of pumping the water stored at the water storage vessel 100, a second passage 150 capable of supplying the water in the water storage vessel 100 to the ice making apparatus 20 and the dispenser 40, and a valve 90 disposed on the second passage 150 and capable of changing a passage. Although to be described later, the second passage 150 as such may form a supply passage while being connected to a first passage 160 that is provided at the water storage vessel 100.

The second passage 150 may include a third passage 151 capable of connecting the water storage vessel 100 to the valve 90, a fourth passage 152 connecting the valve 90 to the ice making apparatus 20, a fifth passage 153 connecting the valve 90 to the dispenser 40, and a connecting pipe 130 which will be described later. Each of the fourth passage 152 and the fifth passage 153 may pass through the upper portion hinge of the door 30.

The third passage 151, the fourth passage 152, and the fifth passage 153 as such may be provided with either a pipe having a predetermined rigidity or a hose having flexibility.

The pump 80 configured to pump water may be installed on the third passage 152, and the valve 90 configured to change a passage may be installed at the intersection at which the third passage 151, the fourth passage 152, and the fifth passage 153 meet.

Thus, the valve 90 may be a 3-way valve having three entry/exit holes. However, according to a third embodiment of the present disclosure which will be described later, the passage conversion may be achieved by using four check valves instead of the 3-way valve. Additional explanations will be provided later.

The water storage vessel 100 may be detachably mounted at the bracket unit 60 that is installed on a rear surface 34 of the door 31, and the water storage vessel 100 mounted at the bracket unit 60 may be supported by a door guard 33 provided at the rear surface 34 of the door 31. The bracket unit 60 may be injection-molded with plastic or steel material, and may be fixedly installed by a fastening member on the rear surface 34 of the door 31.

Although will be explained, through the structure as the above, the ice making apparatus 20 or the dispenser 40 of the refrigerator 1 according to the embodiment of the present disclosure, instead of being supplied with water from an outside water supply source while connected to a faucet, may be able to receive water from the water storage vessel 100 that is detachably mounted at the door 31.

Meanwhile, the bracket unit 60 at which the water storage vessel 100 may be mounted may be provided at a suitable height so that the water may be easily injected to the water storage vessel 100 even after the water storage vessel 100 is already mounted at the bracket unit 60. As an example, as illustrated on FIG. 2, the bracket unit 60 may be provided between the door guard 33 which is the second one from the bottom, and a door guard 35 which is the third one from the bottom.

In addition, a marginal space 141 is provided between the water storage vessel 100 mounted at the bracket unit 60 and the door guard 35 provided at the upper side of the water storage vessel 100, and thus, the mounting of the water storage vessel 100 at the bracket unit 60 may be easily performed, and the injection of water to the water storage vessel 100 may easily be performed even when the water storage vessel 100 is already mounted at the bracket 60.

Meanwhile, the pump 80 and the valve 90, as illustrated on FIG. 2, may be accommodated at an inside a pump housing 140 that is provided at the rear surface of the door 31. The pump housing 140 may form a portion of the bracket unit 60, and may be integrally formed with the identical material of the bracket unit 60. A food storage space 142 configured to store foods while supported by the door guard 33 may be formed at a lower side of the pump housing 140.

Figure 3:
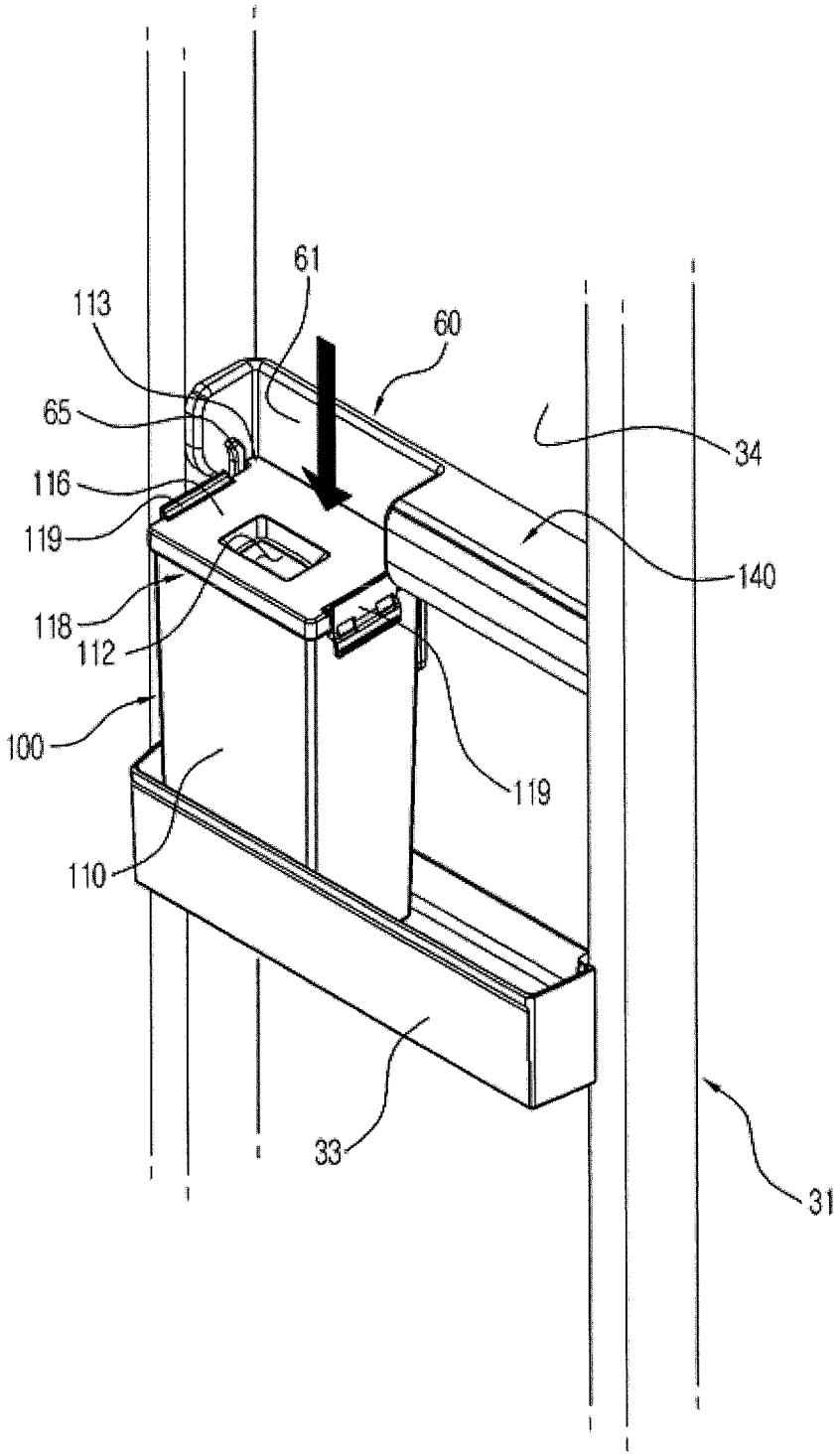
FIG. 3 is a view illustrating a bracket unit having a water storage vessel of the refrigerator of FIG. 1 mounted thereto.
Figure 4:
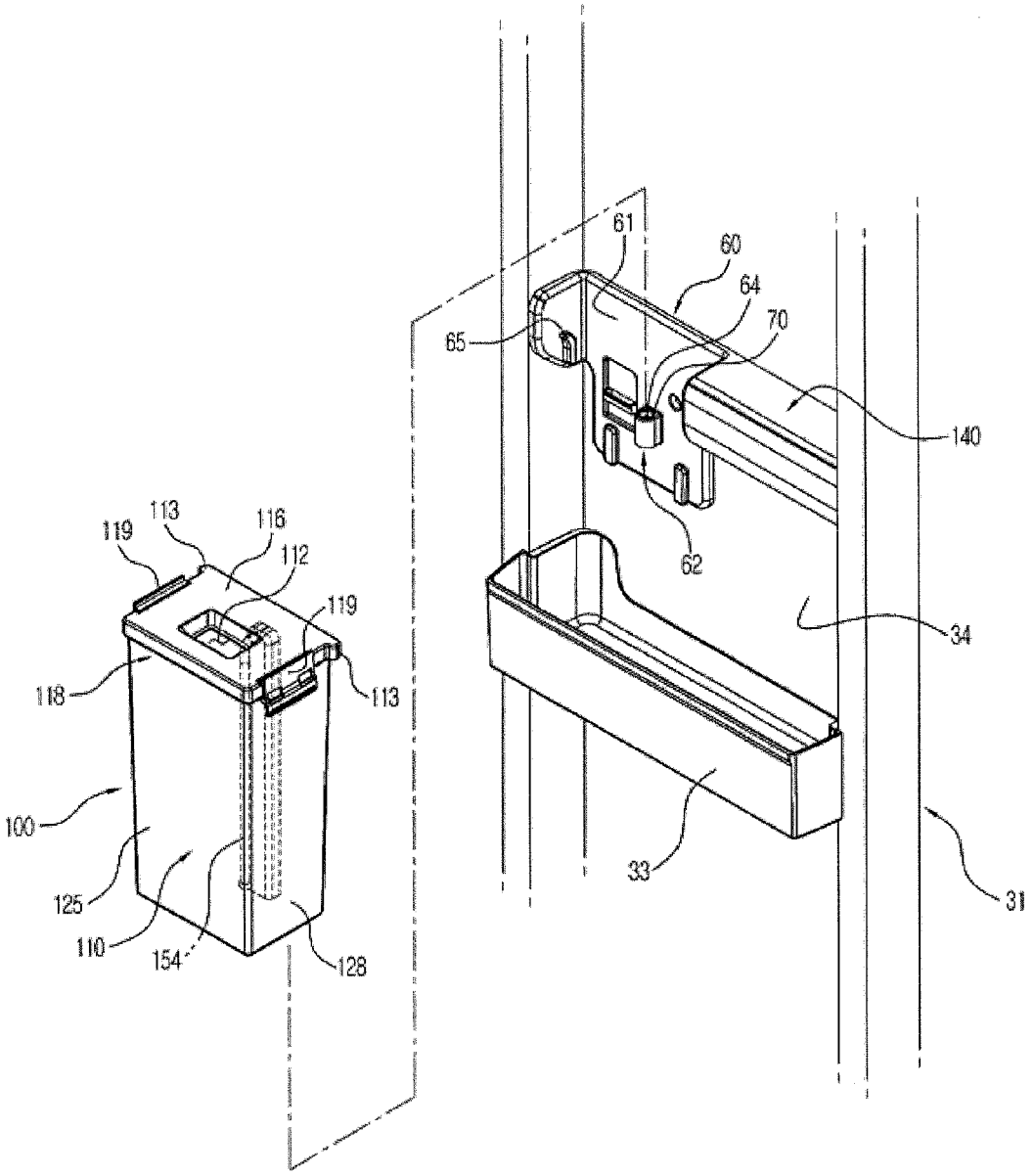
FIG. 4 is a view illustrating a bracket unit having the water storage vessel of the refrigerator of FIG. 1 separated therefrom.
Figure 5:
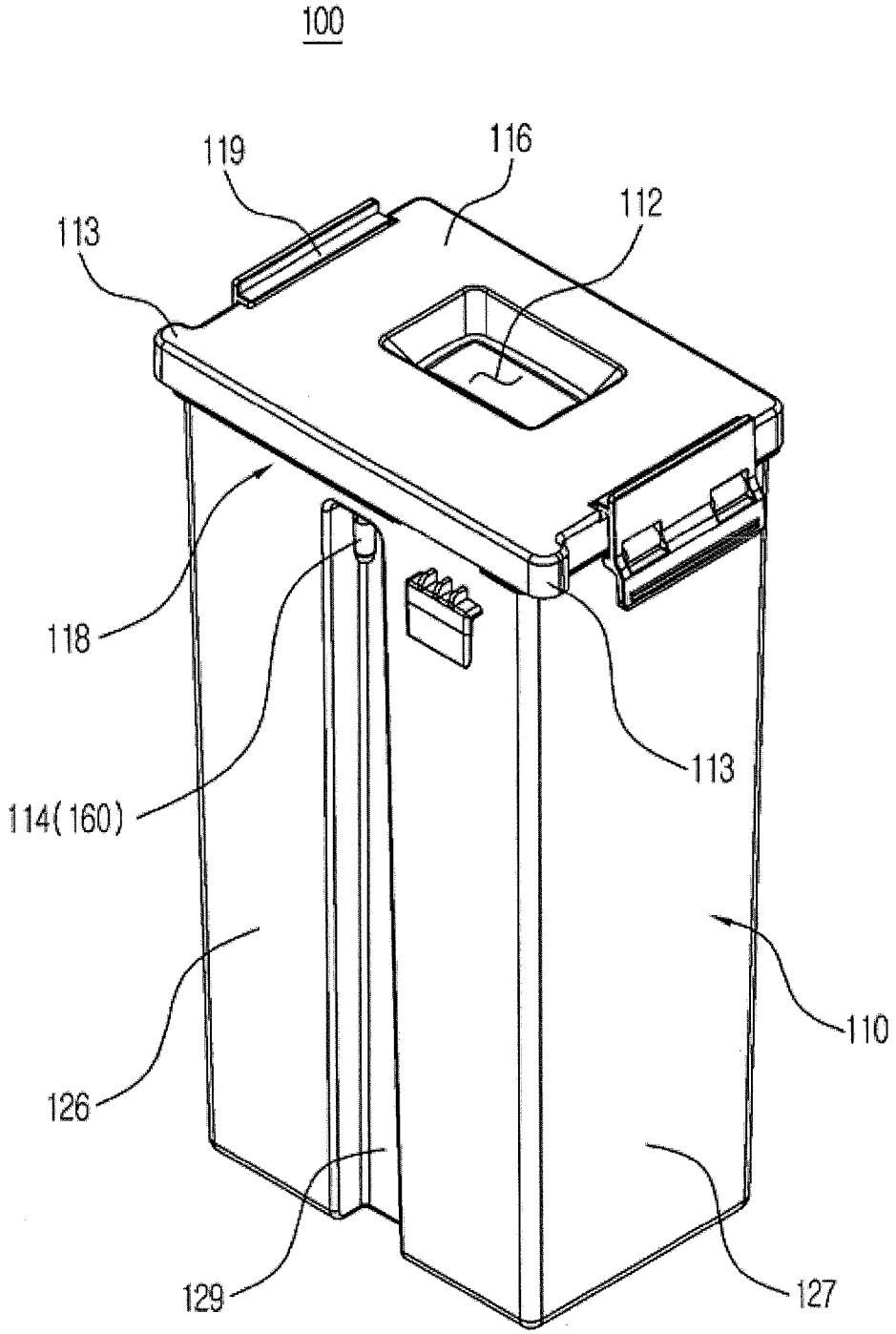
FIG. 5 is a rear perspective view of the water storage vessel of the refrigerator of FIG. 1.
Figure 6:
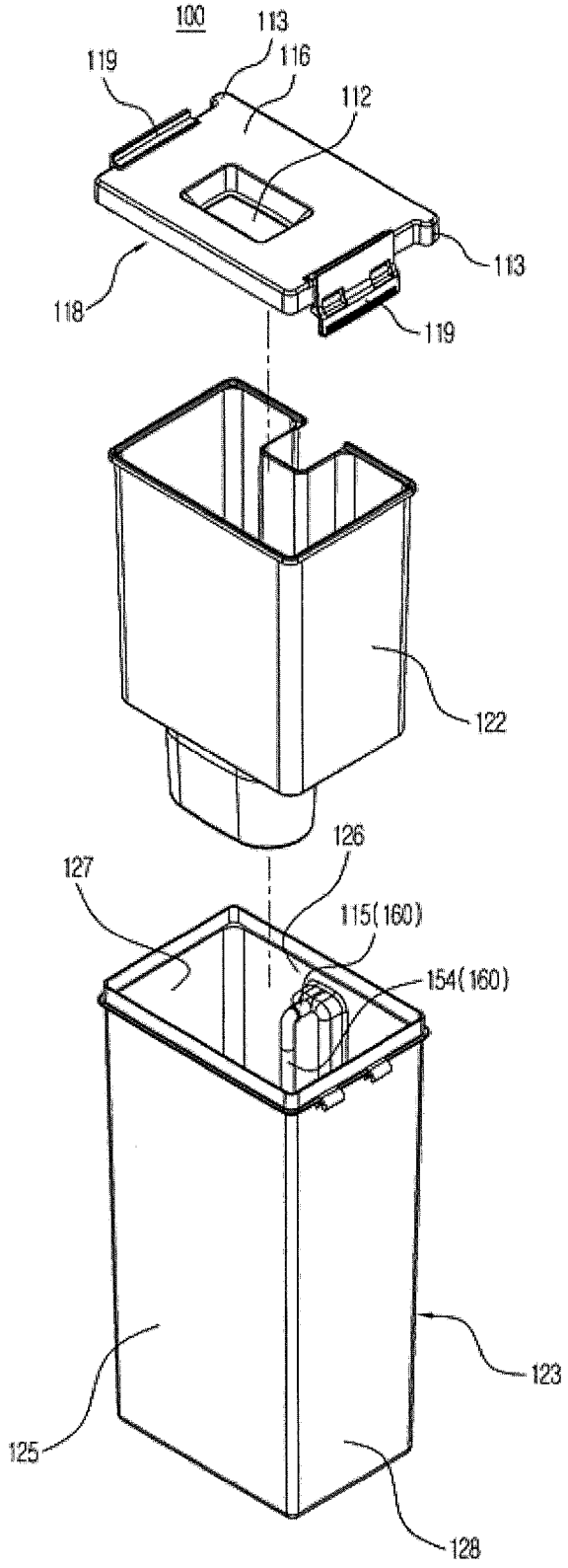
FIG. 6 is an exploded front perspective view of the water storage vessel of the refrigerator of FIG. 1.
Figure 7:
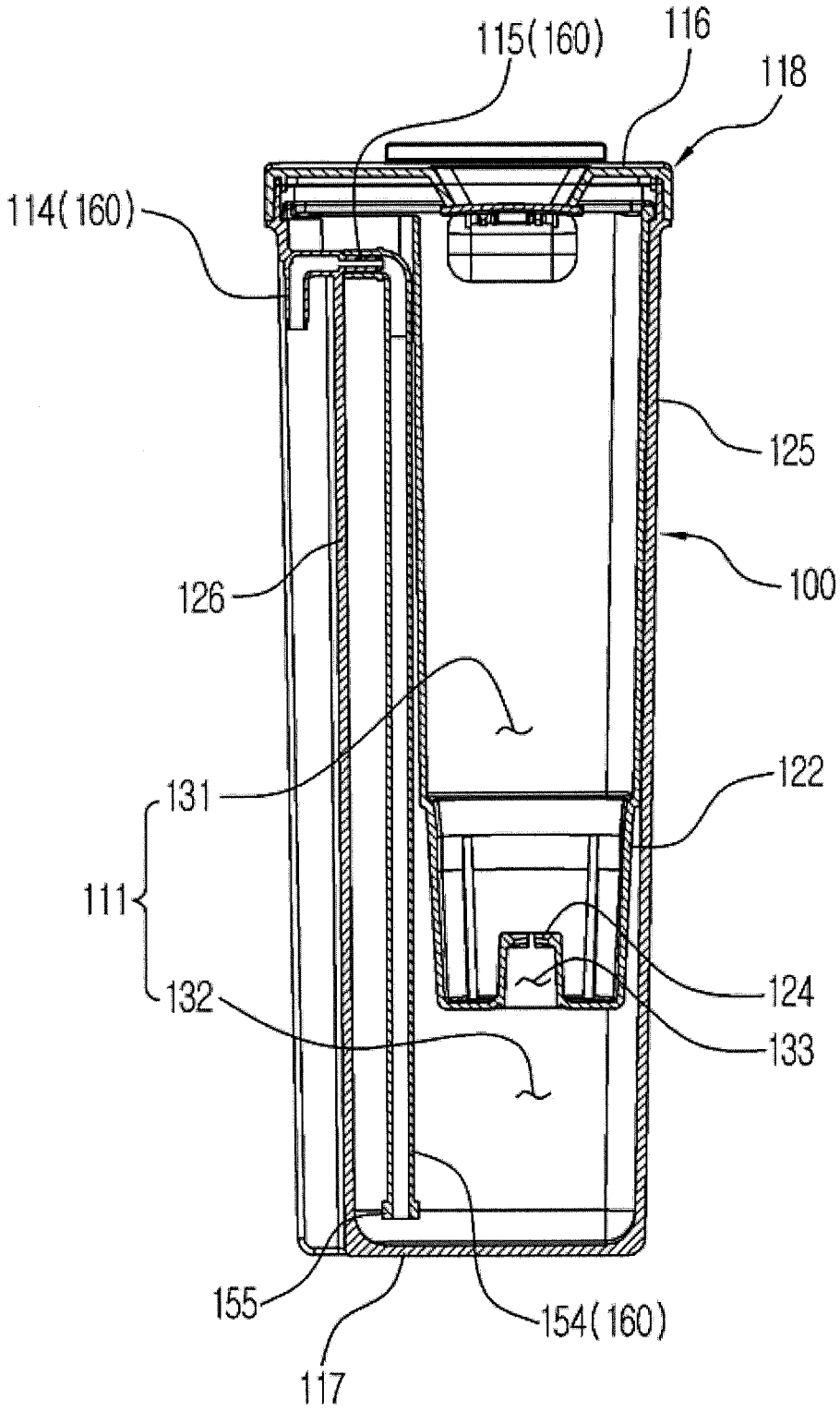
FIG. 7 is a side cross-sectional view of the water storage vessel of the refrigerator of FIG. 1.
Figure 8:
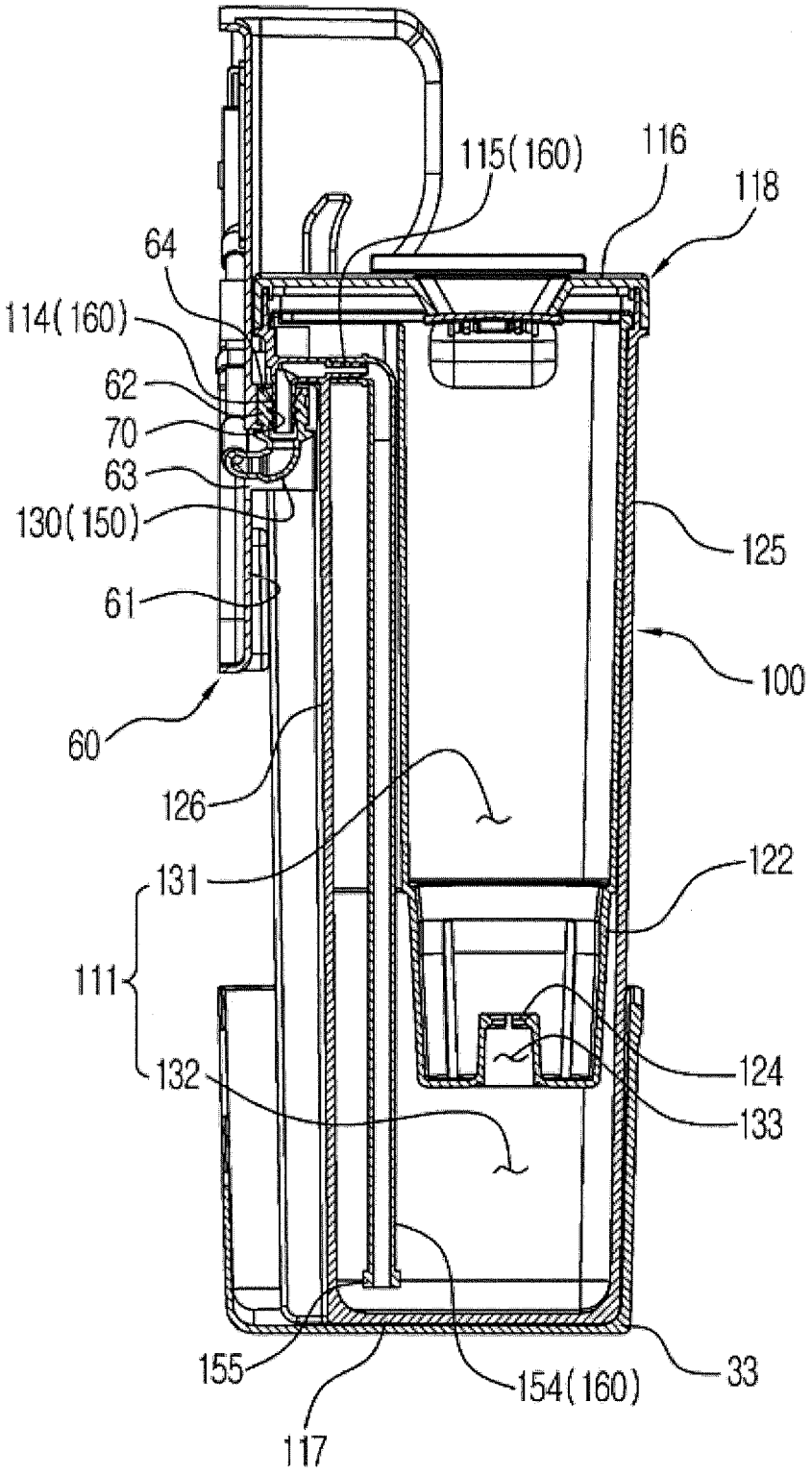
FIG. 8 is a side cross-sectional view of the bracket unit having the water storage vessel of the refrigerator of FIG. 1 mounted thereto.
Figure 9:
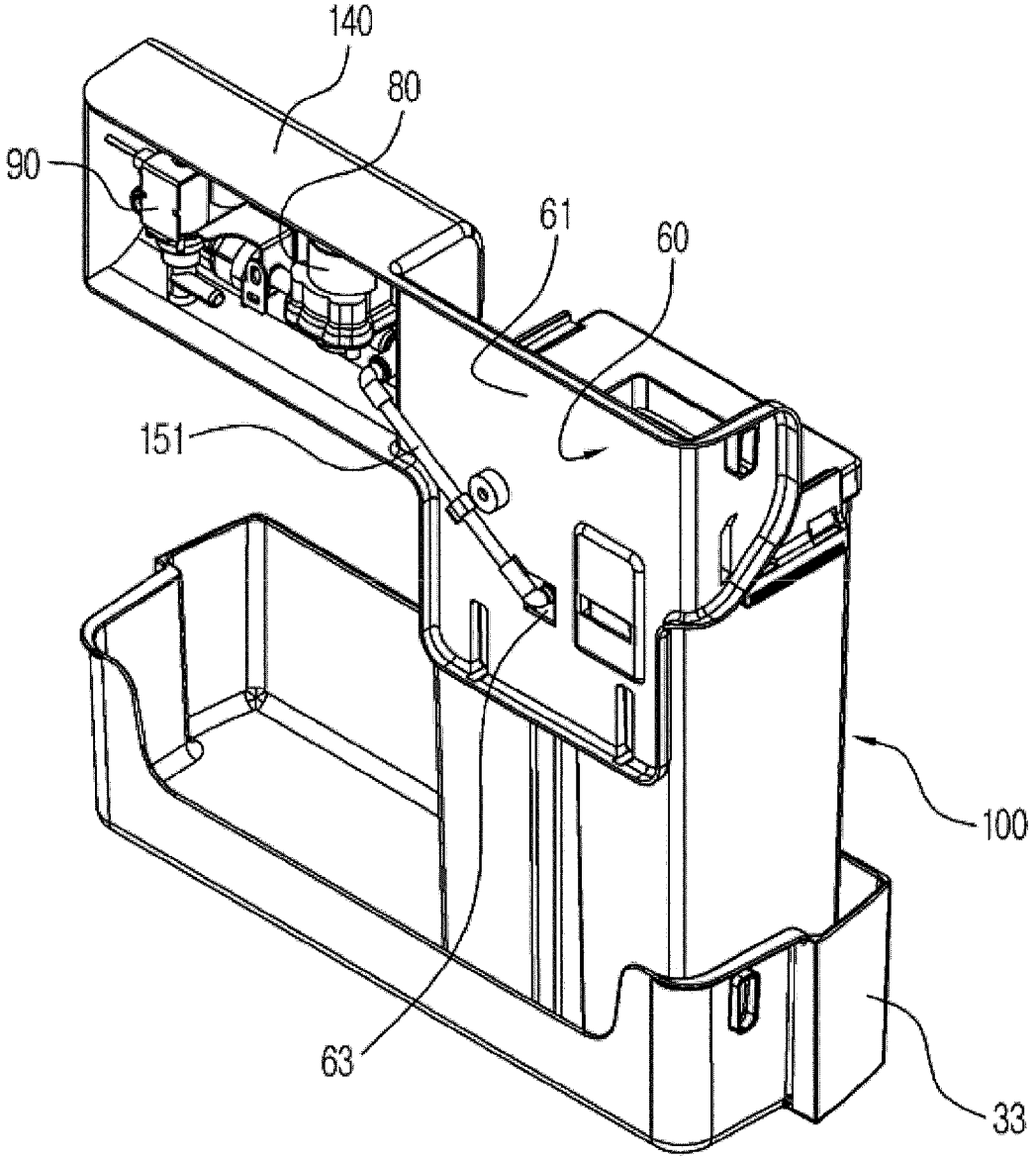
FIG. 9 is a rear perspective view of the bracket unit having the water storage vessel of the refrigerator of FIG. 1 mounted thereto.

FIG. 3 is a view illustrating a bracket unit having a water storage vessel of the refrigerator of FIG. 1 mounted thereto. FIG. 4 is a view illustrating a bracket unit having the water storage vessel of the refrigerator of FIG. 1 separated therefrom. FIG. 5 is a rear perspective view of the water storage vessel of the refrigerator of FIG. 1. FIG. 6 is an exploded front perspective view of the water storage vessel of the refrigerator of FIG. 1. FIG. 7 is a side cross-sectional view of the water storage vessel of the refrigerator of FIG. 1. FIG. 8 is a side cross-sectional view of the bracket unit having the water storage vessel of the refrigerator of FIG. 1 mounted thereto. FIG. 9 is a rear perspective view of the bracket unit having the water storage vessel of the refrigerator of FIG. 1 mounted thereto.

By referring to FIGS. 1 to 9, the attachment/detachment structure of the bracket unit 60 and the water storage vessel 100 of the refrigerator according to the first embodiment of the present disclosure will be explained hereafter. The bracket unit 60 may include a base part 61 and the pump housing 140. The base part 61 has a shape of a plane panel and coupled to the rear surface 34 of the door while being closely adhered to the door. The pump housing 140 protrudes toward a front from the base part 61 to accommodate the pump 80 and the valve 90.

The bracket unit 60 may be provided with a plurality of locking protrusions 65 so that the water storage vessel 100 may be mounted thereon. The water storage vessel 100 may be provided with a plurality of locking steps 113 with which the plurality of locking protrusions 65 is locked.

The locking protrusion 65 is formed in a way that the distance to the base part 61 becomes closer as the locking protrusion 65 faces from an upper side to a lower side thereof, so that the water storage vessel 100 may be mounted to the bracket unit 60 as the locking steps 113 is inserted between the locking protrusion 65 and the base part 61.

The water storage vessel 100 insertedly coupled by the plurality of locking protrusions 65 and the plurality of locking steps 113 as such is additionally supported by the door guard 33 provided at a lower side thereof so that the water storage vessel 100 may be stably mounted to the bracket unit 60.

Meanwhile, the base part 61 of the bracket unit 60 is provided with a penetrating hole (63 in FIG. 9) formed thereon, and the penetrating hole 63 is configured in a way that the second passage 150 may penetrate therethrough. In addition, the base part 61 of the bracket unit 60 is provided with a guide part 62 protruded to a front therefrom so that the connecting pipe 130, which will be described later, may be installed at the base part 61 of the bracket unit 60. The guide part 62 is provided with a hollowness part 64 formed thereon, so that the connecting pipe 130 may be fixedly installed to an inside the hollowness part 64.

The connecting pipe 130 is configured to form a portion of the second passage 150 by being connected to one end of the third passage 151, and is fixed by being inserted into the hollowness 64 of the guide part 62. When the water storage vessel 100 is mounted to the bracket unit 60, the connecting pipe 130 may also be connected to an outside protrusion pipe (114 in FIG. 5) of the water storage vessel 100, which will be described later.

Here, the connecting of the connecting pipe 130 to the outside protrusion pipe 114 represents that the second passage 150 provided at the body 10 and the doors 30 and 31 of the refrigerator 1 is connected to the first passage 160 provided at the water storage vessel 100.

Thus, the water introduced to the connecting pipe 130 through the outside protrusion pipe 114 may flow toward the ice making apparatus 20 or the dispenser 40 through the second passage 150.

A sealing member 70 may be installed around the end portion of the connecting pipe 130 to seal the connecting portion at which the connecting pipe 130 and the outside protrusion unit 114 are in contact to each other. The sealing member 70 may be formed of a rubber material.

In addition, the connecting pipe 130 may be provided with sufficient rigidity so as not to be bent at a time when being connected to the outside protrusion pipe 114. In addition, Either one of the connecting pipe 130 or the outside protrusion pipe 114 may be provided with a predetermined diameter so that either one of the connecting pipe 130 or the outside protrusion pipe may be connected to the other while wrapping around the other.

One side of the connecting pipe 130 that is connected to the outside protrusion pipe 114 may be disposed in a vertical direction. In addition, the other side of the connecting pipe 130 that is connected to the third passage 151 may be disposed in a horizontal direction. Thus, the connecting pipe 130 may have a bent shape at about a 90 degree angle.

Next, as for the description of the water storage vessel 100 that is mounted to the bracket unit 60 as such, the water storage vessel 100 may include a body 110 having a storage space 111 formed at an inside therein to store water and having a general shape of a box, and a water storage vessel cover 118 configured to cover an open upper surface of the body 110.

The water storage vessel cover 118 may be separated from the body 110, and a fastening apparatus 119 may be provided at both sides of the water storage vessel cover 118 so that the water storage vessel cover 118 may be coupled to the body 110. In addition, the water storage vessel cover 118 may be provided with the plurality of locking steps 113, which is previously explained, formed therein, and with an injection hole 112, which is configured to inject water to an inside the water storage vessel 100, formed therein.

Thus, the water storage vessel 100 is provided with a front surface 125, a rear surface 126, a left side surface 127, a right side surface 128, an upper surface 116, and a bottom surface 117, and is provided at the upper surface 116 thereof with the injection hole 112 to inject water to the storage space.

In addition, the water storage vessel 100 may include an inside case 122 having a water purifying filter (124 in FIG. 7) installed therein to filter the water injected through the injection hole 112. The inside case 122 may be separated from the body 110, and may divide the storage space 111 into a first storage space 131 and a second storage space 132 while mounted to the body 110.

The inside case 122 is provided with a communication hole 133, which is configured to allow the first storage space 131 to communicate with the second storage space 132, and the water purifying filter 124 may be installed at the communication hole 133. Thus, the water injected to the first storage space 131 may flow to the second storage space 132 after being purified through the water purifying filter 124.

The inside case 122 may be detached from the body 110. Thus, in a case when a cleaning or a replacement of the water purifying filter 124 is needed, the inside case 122 may be detached from the body 110 to either clean or replace the water purifying filter 124 conveniently.

Since the water storage vessel 100 as the above is provided therein with the first storage space 131 and the second storage space 132 that are available to be detached from one another, and the water purifying filter 124 is installed at the communication hole 133 that is configured to communicate the first storage space 131 to the second storage space 132, the water that is not completely purified may be injected to the water storage vessel 100, and using the water as such may be possible.

The water storage vessel 100 as such is provided therein with a first passage 120 to intake the water stored at an inside thereof. The first passage 120 may include the outside protrusion pipe 114 protruded to an outer side from the rear surface 126 of the body 110, an inside protrusion pipe 115 protruded from the rear surface 126 of the body 110 toward an inner side, and an intake passage 154 connected to the inside protrusion pipe 115 and extended to the bottom surface 117 of the body 110.

Here, the outside protrusion pipe 114 and the inside protrusion pipe 115 may be integrally injection-molded with the body 110, using the material that composes the body 110, thereby having predetermined rigidity.

The intake passage 154 may be provided with rigidity or flexibility, and the entry 155 of the intake passage 154 is disposed at the second storage space 132 to intake the water stored at the second storage space 132 of the water storage vessel 100.

Since the outside protrusion pipe 114 and the inside protrusion pipe 115 are provided in a way that the outside protrusion pipe 114 and the inside protrusion pipe 115 communicate with each other, and the inside protrusion pipe 115 is connected to the intake passage 154, the water stored at the water storage vessel 100 sequentially passes through the inside protrusion pipe 115 and the outside protrusion pipe 114, and flows to the connecting pipe 130 that is installed at the bracket unit 60. In addition, one side of the outside protrusion pipe 114 may be extended to a vertical direction to be connected to one side of the connecting pipe 130 that is disposed in a vertical direction.

Meanwhile, a groove part (129 in FIG. 5) that is recessed inward is formed at the rear surface of the body 110 so as to prevent the water storage vessel 100 from interfering with guide part 62 of the bracket unit 60 at the time when the water storage vessel 100 moves in a direction from an upper side to a lower side.

As the above, the injection hole 112 which is configured to inject water to an inside the water storage vessel 100 is formed at the upper surface 116 of the water storage vessel 100, and the outside protrusion pipe 114 and the inside protrusion pipe 115 through which the water inside exits is formed at the rear surface 126 of the water storage vessel 100, and thus, water may be easily injected to the water storage vessel 100 even in a state when the water storage vessel 100 is already mounted to the bracket unit 60. Thus, the water storage vessel 100 is not needed to be detached from the bracket unit 60 in order to inject water to the water storage vessel 100.

Figure 10:
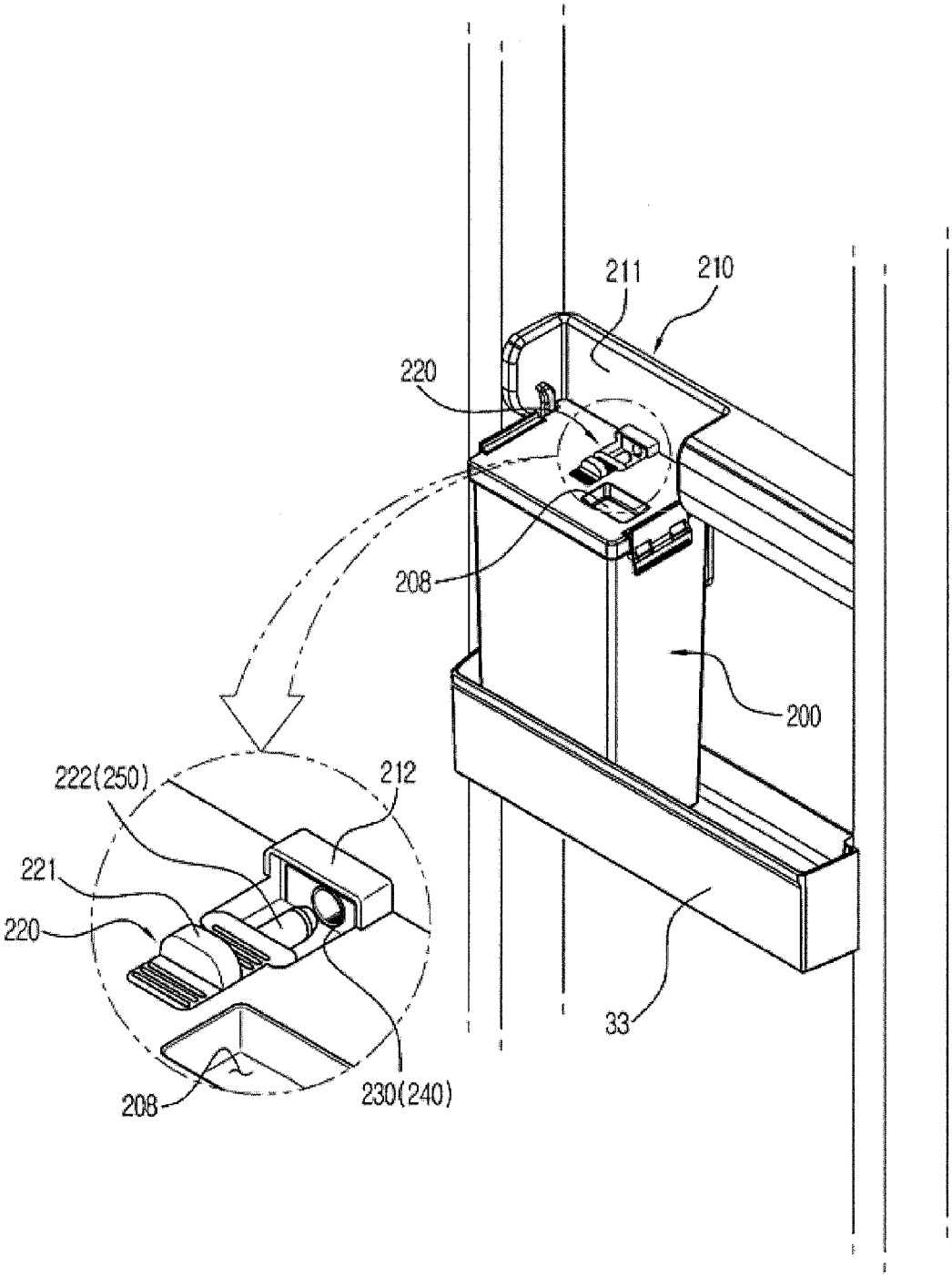
FIG. 10 is a view illustrating a bracket unit in a state that a water storage vessel lever of a refrigerator in accordance with a second embodiment of the present disclosure is open.
Figure 11:
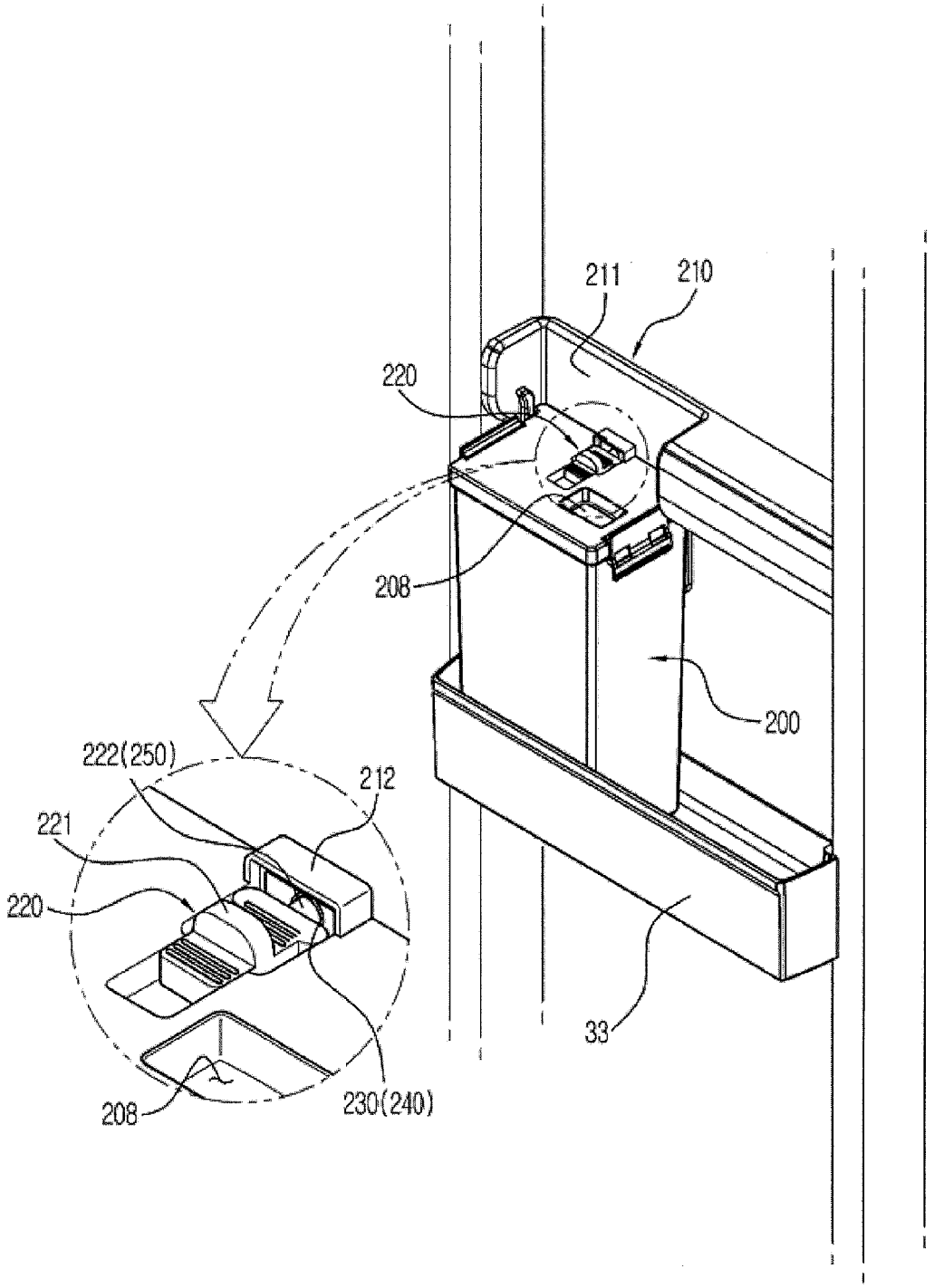
FIG. 11 is a view illustrating a bracket unit in a state that a water storage vessel lever of the refrigerator of FIG. 10 is closed.
Figure 12:
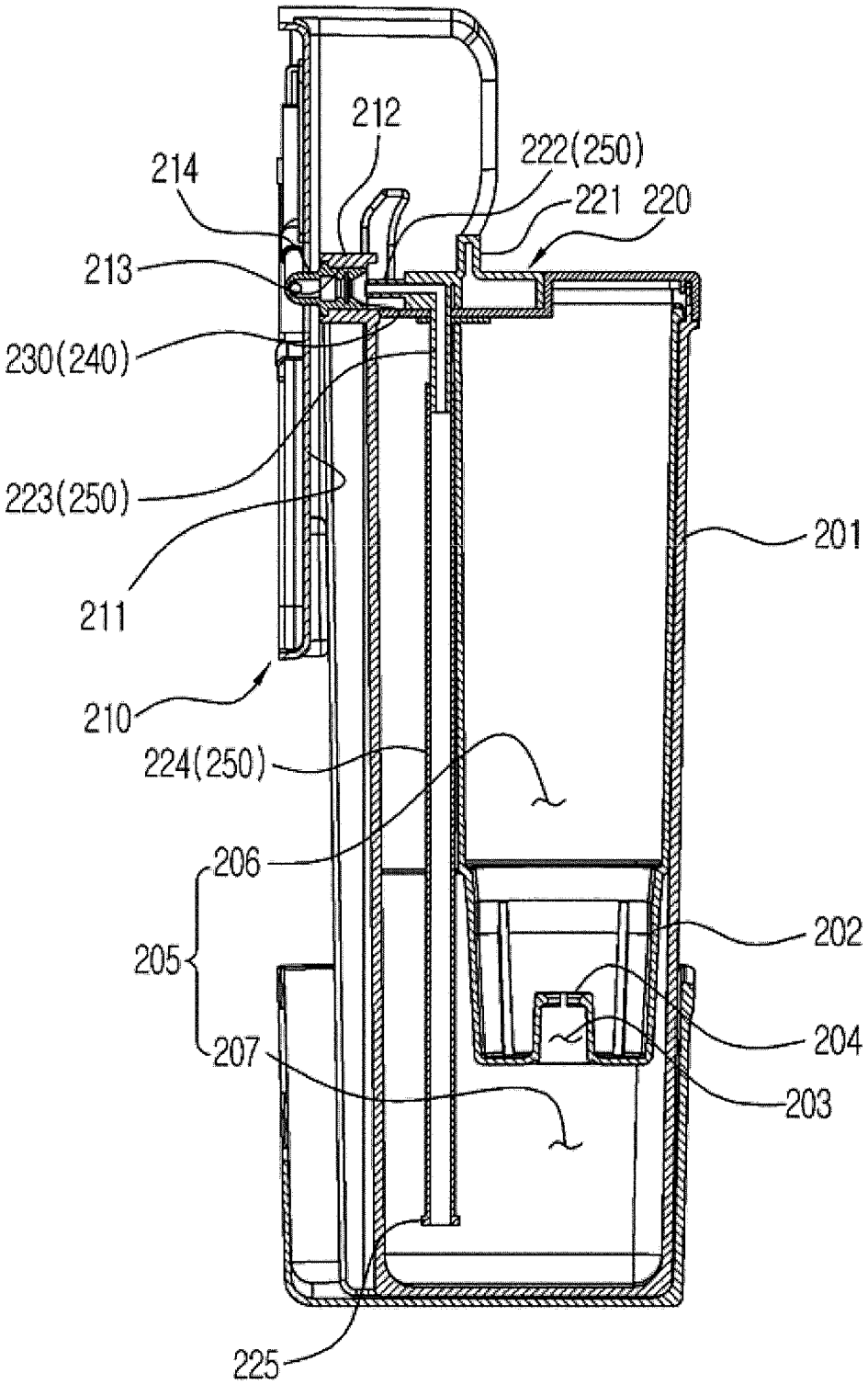
FIG. 12 is a side cross sectional view illustrating a bracket unit in a state that the water storage vessel lever of the refrigerator of FIG. 10 is open.
Figure 13:
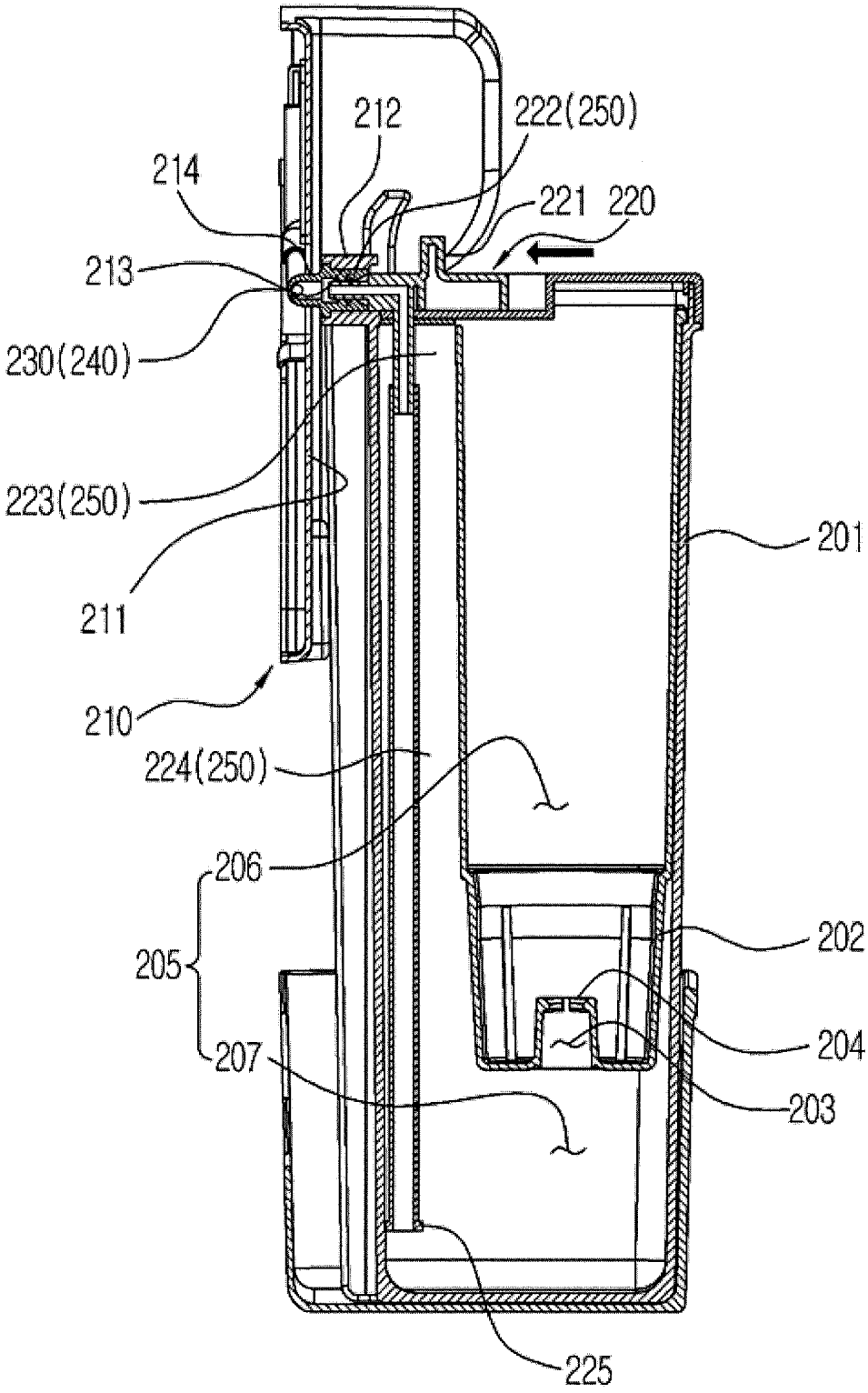
FIG. 13 is a side cross sectional view illustrating a bracket unit in a state that the water storage vessel lever of the refrigerator of FIG. 10 is closed.

FIG. 10 is a view illustrating a bracket unit in a state that a water storage vessel lever of a refrigerator in accordance with a second embodiment of the present disclosure is open. FIG. 11 is a view illustrating a bracket unit in a state that a water storage vessel lever of the refrigerator of FIG. 10 is closed. FIG. 12 is a side cross sectional view illustrating a bracket unit in a state that the water storage vessel lever of the refrigerator of FIG. 10 is open. FIG. 13 is a side cross sectional view illustrating a bracket unit in a state that the water storage vessel lever of the refrigerator of FIG. 10 is open.

By referring to FIGS. 10 to 13, a refrigerator according to the second embodiment of the present disclosure will be explained. With respect to the same structure as that of the first embodiment of the present disclosure, the same reference numerals will be used to designate the same structures hereafter, while the explanations of such may be omitted.

According to the second embodiment of the present disclosure, a bracket unit 210 configured to have a water storage vessel 200 mounted thereto is installed at a rear surface of the door 31, and the structure of the bracket unit 210 is mostly same as the structure of the first embodiment. The bracket unit 210 may include a base part 210 formed in a plane manner to be closely coupled to the rear surface of the door 31, and a guide part 211 protruded from the base part 210 toward a front.

The guide part 211 is provided with a hollowness part 212 formed thereon, and the hollowness part 212 is provided with a connecting pipe 230 fixedly installed thereto in a horizontal direction. The connecting pipe 230 is configured to form an entry of a second passage 240 that is connected to the ice making apparatus 20 and the dispenser 40. In addition, a sealing member 213 may be provided around the connecting pipe 230 to seal the connecting portion at which the connecting pipe 230 and an outside protrusion pipe 230, which will be described later, are in contact to each other.

The water storage vessel 200 according to the second embodiment of the present disclosure may include a body 201 forming a storage space 205 at an inside the water storage vessel 200 and an inside case 202 mounted at an inside the body 201 to divide the storage space 205 into a first storage space 206 and a second storage space 207.

The inside case 202 is provided therein with a communication hole 203 that is configured to allow the first storage space 206 to communicate with the second storage space 207, and a water purifying filter 204 to filter water may be installed at the communication hole 203.

An injection hole 208 is provided at an upper surface of the body 201 to inject water, and the water injected through the injection hole 208 may flow to the first storage space 206. The water introduced to the first storage space 206 is purified through the water purifying filter 204, and then may flow to the second storage space 207.

In addition, the water storage vessel 200 further includes a first passage 250 configured to intake the water stored in the second storage space 207 and a water storage vessel lever 220 capable of changing the position of the first passage 250.

The first passage 250 may include an outside protrusion pipe 222 protruded from the body 201 to an outer side, an inside protrusion pipe 223 protruded from the body 201 to an inner side, and an intake passage 224 connected to the inside protrusion pipe 223.

The outside protrusion pipe 222 and the inside protrusion pipe 223 communicate with one another. The outside protrusion pipe 222 may be horizontally disposed, and the inside protrusion pipe 223 may be vertically disposed. An entry 225 of the intake passage 224 is disposed at the second storage space 207 and may intake the water stored at the second storage space 207.

Here, the outside protrusion pipe 222 and the inside protrusion pipe 223 are provided to have predetermined rigidity, while the intake passage 224 may be provided to have either predetermined rigidity or flexibility.

The water storage vessel lever 220 is provided at the upper surface of the water storage vessel 200 in a way to be able to move forward/backward directions, and may include a pressing part 221 to move the water storage vessel lever 220 in forward/backward directions by pressing the water storage vessel lever 220.

The outside protrusion pipe 222 and the inside protrusion pipe 223 of the first passage 250 may move by interacting with the forward/backward direction motion of the water storage vessel lever 220, and furthermore, the outside protrusion pipe 222 and the inside protrusion pipe 223 may be integrally provided with the water storage vessel lever 220.

Thus, if the water storage vessel lever 220 is moved toward the back side of the door 31 by pressing the pressing part 221 of the water storage vessel lever 220 after the water storage vessel 220 is installed at the bracket unit 210, the outside protrusion pipe 222 of the first passage 250 moves, along with the movement of the water storage vessel level 220, toward the back side of the door 31 while the outside protrusion pipe 222 may be connected to the connecting pipe 230 that is disposed in a horizontal direction at the bracket unit 210.

The above represents that the first passage 250 is connected to the second passage 240, and thus, the water in the water storage vessel 220 may be supplied to the ice making apparatus 20 or the dispenser 40.

Figure 14:
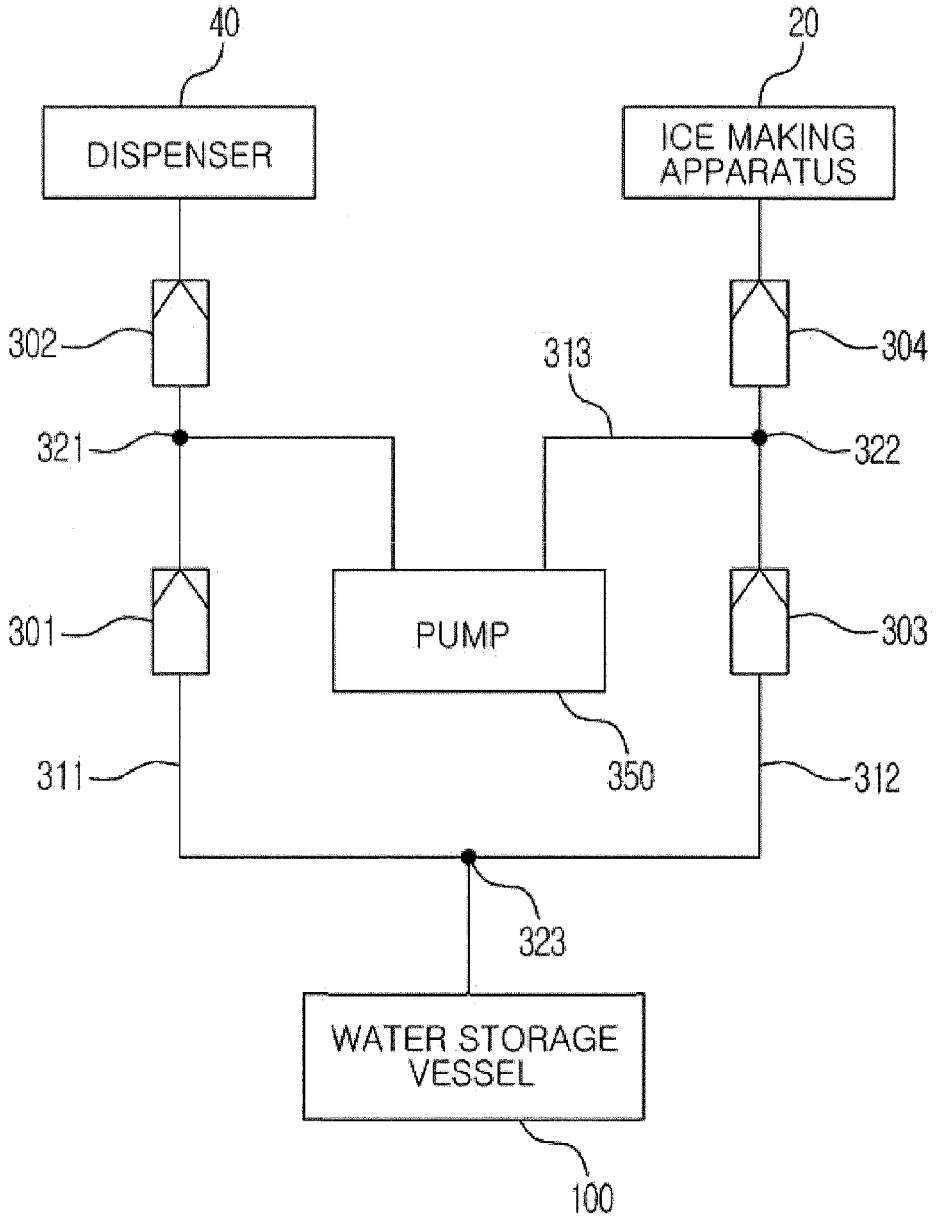
FIG. 14 is a block diagram illustrating a water supply of a refrigerator in accordance with a third embodiment of the present disclosure.
Figure 15:
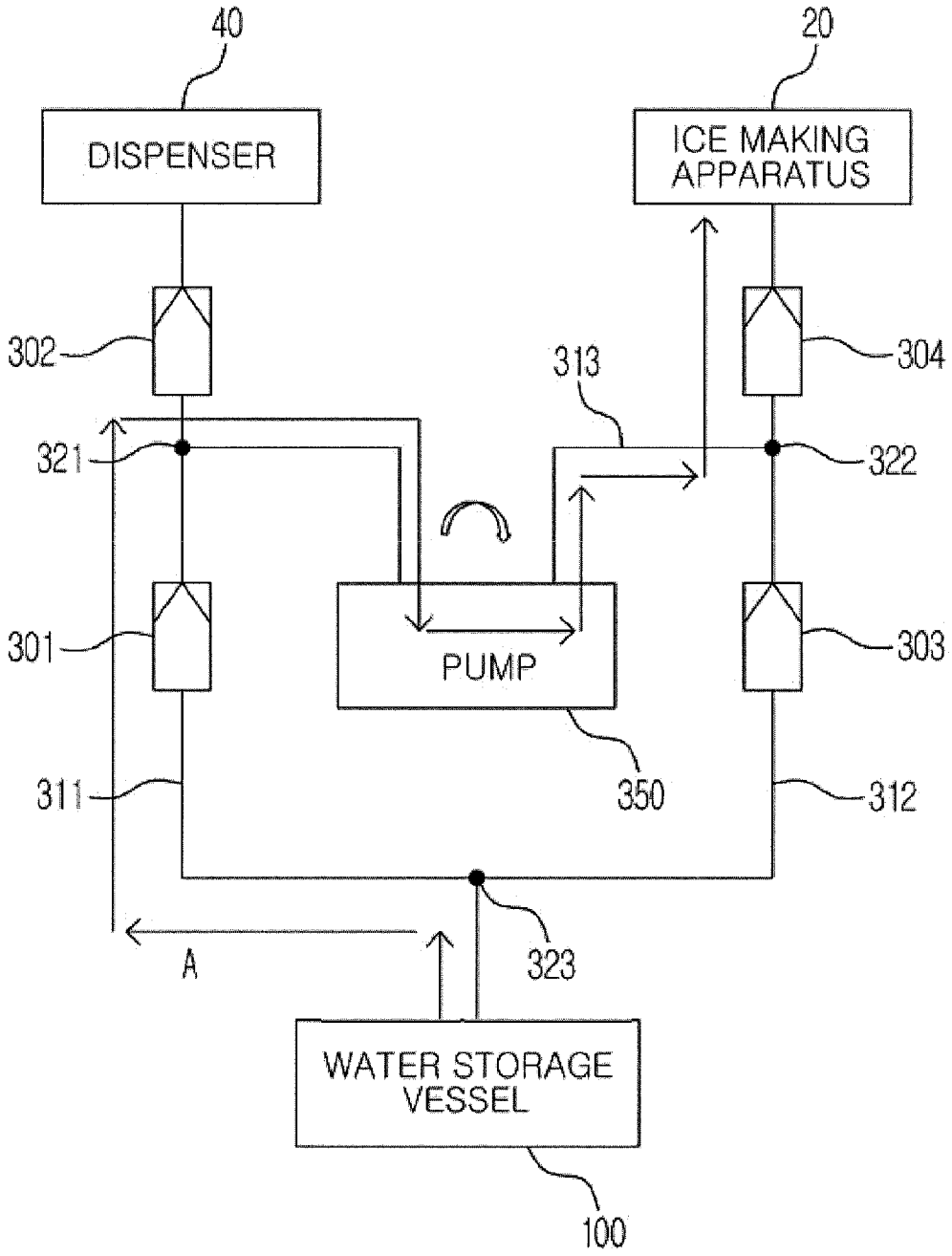
FIG. 15 is a block diagram illustrating a water supply in a case when water is supplied to an ice making apparatus of the refrigerator of FIG. 14.
Figure 16:
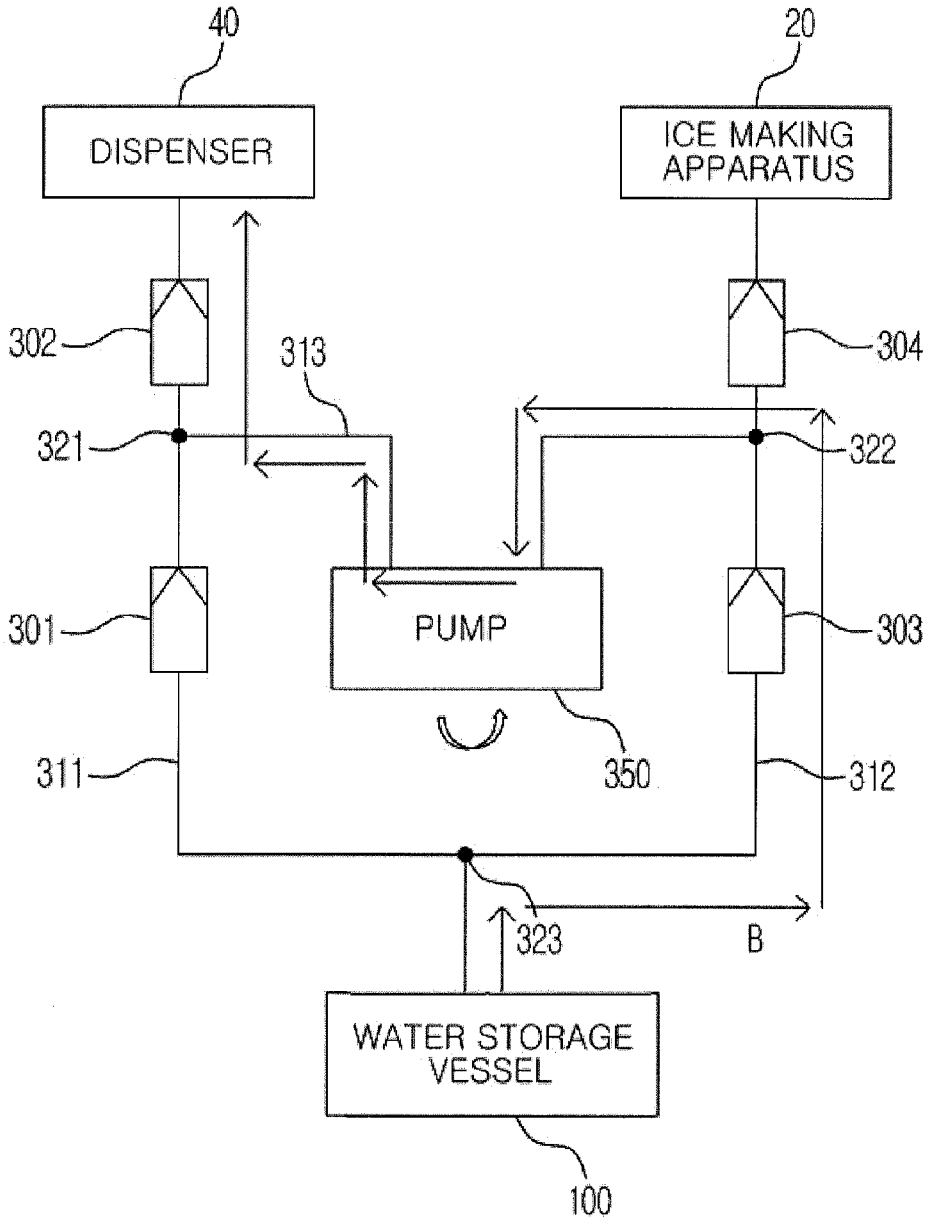
FIG. 16 is a block diagram illustrating a water supply in a case when water is supplied to a dispenser of the refrigerator of FIG. 14.
Figure 17:
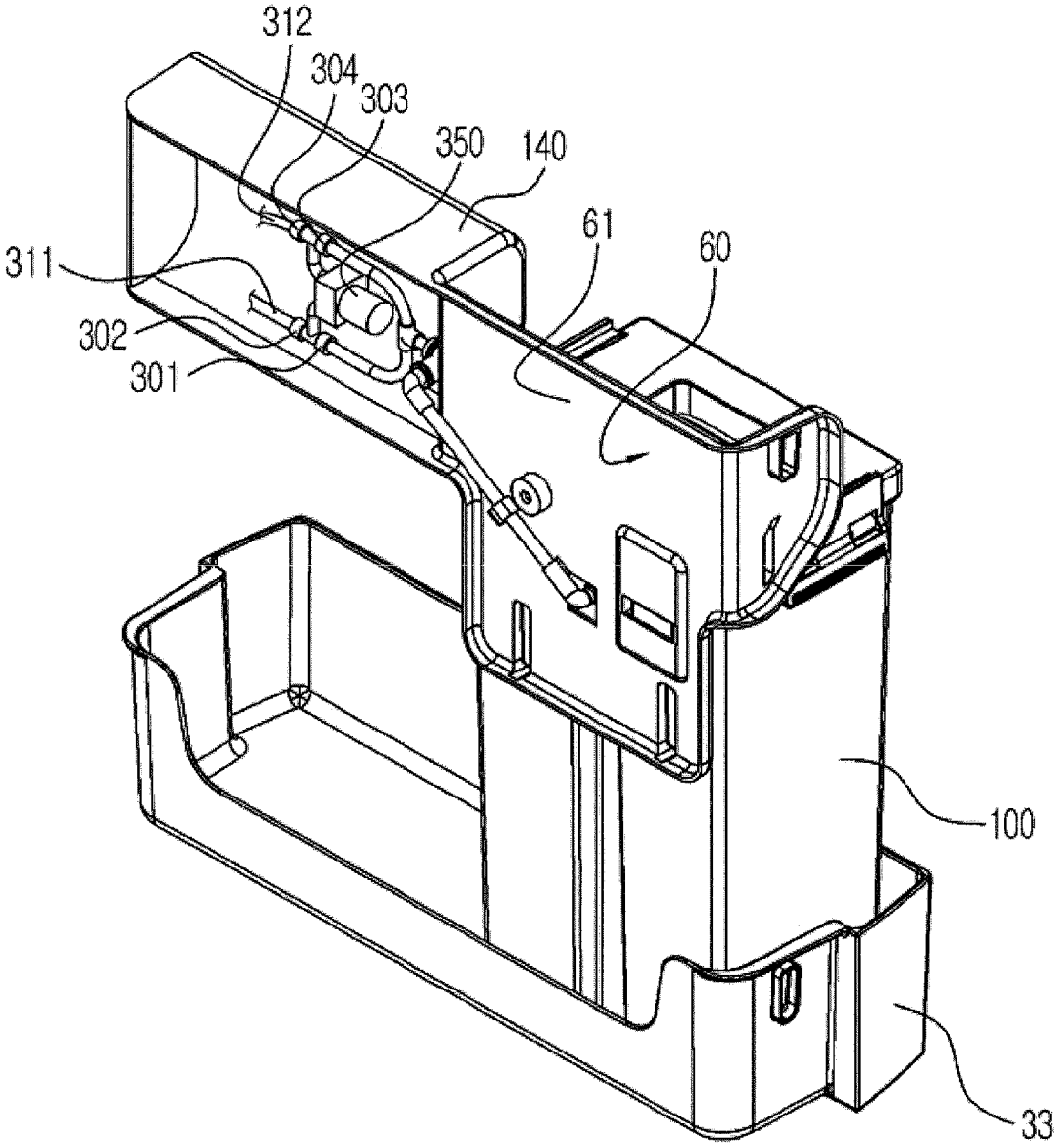
FIG. 17 is a rear perspective view of a pump housing of the refrigerator of FIG. 14.

FIG. 14 is a block diagram illustrating a water supply of a refrigerator in accordance with a third embodiment of the present disclosure. FIG. 15 is a block diagram illustrating a water supply in a case when water is supplied to an ice making apparatus of the refrigerator of FIG. 14. FIG. 16 is a block diagram illustrating a water supply in a case when water is supplied to a dispenser of the refrigerator of FIG. 14. FIG. 17 is a rear perspective view of a pump housing of the refrigerator of FIG. 14.

As illustrated on FIGS. 14 to 17, a water supply system of a refrigerator, according to the third embodiment of the present disclosure, may be able to selectively supply water to the ice making apparatus 20 and the dispenser 40 by using four check valves 301, 302, 303, and 304 instead of the 3-way valve which is described earlier along with a pump 350 capable of reciprocal rotation.

As illustrated on FIG. 14, a supply passage includes a first sub passage 311 connecting the water storage vessel 100 to the dispenser 40, a second sub passage 312 connecting the water storage vessel 100 to the ice making apparatus 20, and a third sub passage 313 connecting one point 321 of the first sub passage 311 to one point 322 of the second sub passage 312.

The first sub passage 311 and the second sub passage 312 may divide apart at the one point 323 after starting as a single passage from the water storage vessel 100.

At this time, the first check valve 301 and the second check valve 302 are installed to the first sub passage 311 at a front position and a rear position of the one point 321, respectively, to prevent the water flowing backward to the water storage vessel 100. In addition, the third check valve 303 and the fourth check valve 304 are installed to the second sub passage 311 at a front position and a rear position of the one point 322, respectively, to prevent water flowing backward to the water storage vessel 100.

In addition, the pump 350, which is capable of rotating clockwise and counterclockwise directions, is installed to the third sub passage 313. The pump 350 is provided with a plurality of entry/exit holes, and each of the entry/exit holes may be connected to the third sub passage 313. In addition, the pump 350 may include an impeller configured to forcedly circulate water and a driving motor configured to rotate the impeller to a clockwise or counterclockwise direction.

Thus, a certain one of the entry/exit holes of the pump 350 is connected to the first check valve 301 and the second check valve 302, and a certain the other one of the entry/exit holes of the pump 350 is connected to the third check valve 303 and the fourth check valve 204.

Each of the check valves 301, 302, 303, and 304 prevents water flowing backward to the water storage vessel 100, and forces the water to flow only to a direction illustrated as an arrow. The dispenser 40 is connected to an exit side of the second check valve 302, and the ice making apparatus 20 is connected to an exit side of the fourth check valve 304.

As illustrated on FIG. 15, when the pump 350 is rotated to a clockwise direction, the water stored in the water storage vessel 100, by the intake force of the pump 350, moves along the direction A illustrated as an arrow, and is supplied to the ice making apparatus 20.

That is, the water stored in the water storage vessel 100, after sequentially passing through the first check valve 301, the pump 350, and the fourth check valve 304, may be supplied to the ice making apparatus 20.

At this time, the water passed through the first check valve 301 flows toward the side of the pump 350 by the intake force of the pump 350, and the water passed through the pump 350, since the water may not pass through the third check valve 303, only flows toward the side of the fourth check valve 304 to be supplied to the ice making apparatus 20.

In addition, as illustrated on FIG. 16, when the pump 350 is rotated to a counterclockwise direction, the water stored in the water storage vessel 100, by the intake force of the pump 350, moves along the direction B illustrated as an arrow, and is supplied to the dispenser 40.

That is, the water stored in the water storage vessel 100, after sequentially passing through the third check valve 303, the pump 350, and the second check valve 302, may be supplied to the dispenser 40.

At this time, the water passed through the fourth check valve 304 flows toward the side of the pump 350 by the intake force of the pump 350, and the water passed through the pump 350, since the water may not pass through the first check valve 301, only flows toward the side of the second check valve 302 to be supplied to the dispenser 40.

Meanwhile, as illustrated on FIG. 17, the check valves 301, 302, 303, and 304 as well as the pump 350, may be accommodated at the pump housing 140. The pump housing 140 as such is provided at a higher position when compared to the position of the water storage vessel 100, and thus, in a case when the pump 350 is not rotated to any direction, the water stored in the water storage vessel 100 is not supplied to the ice making apparatus 20 or the dispenser 40 and may stay in the water storage vessel 100.

According to the third embodiment of the present disclosure as such, the passage conversion may be achieved even if deleting the conventional 3-way valve, thereby reducing the production cost and achieving compact size components.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

a storage compartment having a front surface available to be open at an inside of the body;

a door rotatably installed at the body to open/close the open front surface of the storage compartment;

an ice making apparatus provided at the inside of the body to generate ice;

a dispenser configured to discharge water and ice to an outside of the body; and a water supplying apparatus configured to supply water to the ice making apparatus and the dispenser, wherein the water supplying apparatus, comprises a water storage vessel provided with a water storage body having a storage space formed at an inside thereof;

a first passage provided on the water storage vessel and capable of intaking the water stored at the storage space;

a bracket unit installed on a rear surface of the door and having the water storage vessel mounted thereto;

a second passage connected to the first passage and capable of supplying the water in the water storage vessel to the ice making apparatus and the dispenser;

a valve installed at an intersection of the second passage and configured to change a passage;

a pump configured to pump the water in the water storage vessel so that the water flows to the second passage; and a water storage vessel lever provided on the water storage vessel, the water storage vessel lever being configured to horizontally slide between an ON position at which the first passage is connected to the second passage, and an OFF position at which the first passage is disconnected from the second passage, wherein the first passage of the water storage vessel is connected to the second passage and supplies the water stored at the water storage vessel to the ice making apparatus or the dispenser when the water storage vessel is mounted to the bracket unit and the water storage vessel lever is at the ON position, and wherein the first passage of the water storage vessel is disconnected from the second passage when the water storage vessel is mounted to the bracket unit and the water storage vessel lever is at the OFF position.

2. The refrigerator of claim 1, wherein the water storage vessel lever comprises a pressing part capable of moving the water storage vessel lever by applying a pressure.

3. The refrigerator of claim 1, wherein the water storage vessel comprises an outside protrusion pipe protruded to an outer side from the water storage body and an inside protrusion pipe protruded to an inner side from the water storage body, the outside protrusion pipe and the inside protrusion pipe communicate with each other, and the outside protrusion pipe and the inside protrusion pipe form at least a portion of the first passage.

4. The refrigerator of claim 3, wherein the outside protrusion pipe and the inside protrusion pipe are integrally formed with the water storage vessel lever.

5. The refrigerator of claim 3, wherein the outside protrusion pipe is horizontally disposed.

6. The refrigerator of claim 3, wherein the outside protrusion pipe moves in a vertical direction with respect to the rear surface of the door.

7. The refrigerator of claim 1, wherein the water storage vessel lever is provided at an upper surface of the water storage body.

8. The refrigerator of claim 1, wherein the bracket unit comprises:

a base part coupled to the rear surface of the door;

a guide part protruded from the base part to guide the connection of the second passage and the first passage and provided with a hollowness formed therethrough; and a connecting pipe inserted into the hollowness of the guide part and configured to form an entry to the second passage.

9. The refrigerator of claim 8, wherein the connecting pipe is fixedly installed at the bracket unit and horizontally disposed.

10. A refrigerator, comprising:

a body;

a storage compartment having a front surface available to be open at an inside the body;

a door rotatably installed at the body to open/close the open front surface of the storage compartment;

an ice making apparatus provided at an inside the body to generate ice;

a dispenser configured to discharge water and ice to an outside the body;

a water storage vessel having a storage space to store water and configured to be mounted to the door;

a supply passage configured to connect the storage space of the water storage vessel to the ice making apparatus and the dispenser to supply the water in the water storage vessel to the ice making apparatus and the dispenser;

a valve installed at an intersection of the supply passage and configured to perform a passage conversion;

a pump configured to pump the water in the water storage vessel so that the water flows to the supply passage; and a water storage vessel lever provided on the water storage vessel, the water storage vessel lever being configured to horizontally slide between a first position where at least one portion of the supply passage is connected to a remaining portion of the supply passage and a second position where the at least one portion of the supply passage is disconnected from the remaining portion of the supply passage when the water storage vessel is mounted to the door.

11. The refrigerator of claim 10, wherein the valve comprises first, second, third and fourth check valves, and the valve does not comprise a three way valve.

12. The refrigerator of claim 11, wherein the supply passage comprises:

a first sub passage connecting the water storage vessel to the dispenser;

a second sub passage connecting the water storage vessel to the ice making apparatus; and a third sub passage connecting one point of the first sub passage to one point of the second sub passage, wherein the first sub passage and the second sub passage divide apart after starting as a single passage from the water storage vessel.

13. The refrigerator of claim 12, wherein, to prevent the water flowing backward to the water storage vessel, the first check valve and the second check valve are installed in the first sub passage at a front position and a rear position of the one point of the first sub passage, respectively, and the third check valve and the fourth check valve are installed in the second sub passage at a front position and a rear position of the one point of the second sub passage, respectively.

14. The refrigerator of claim 1, wherein the first passage of the water storage vessel also disconnects from the second passage when the water storage vessel is dismounted from the bracket unit.

* * * * *